US009351567B2

(12) United States Patent
Go

(10) Patent No.: US 9,351,567 B2
(45) Date of Patent: May 31, 2016

(54) PREFABRICATED SHELF

(71) Applicant: Jin Hee Go, Chungcheongbuk-do (KR)

(72) Inventor: Jin Hee Go, Chungcheongbuk-do (KR)

( * ) Notice: Subject to any disclaimer, the term of this patent is extended or adjusted under 35 U.S.C. 154(b) by 0 days.

(21) Appl. No.: 14/810,965

(22) Filed: Jul. 28, 2015

(65) Prior Publication Data

US 2016/0029787 A1 Feb. 4, 2016

(30) Foreign Application Priority Data

Aug. 4, 2014 (KR) ..... 10-2014-0100062

(51) Int. Cl.

| | |
|---|---|
| ***A47B 57/10*** | (2006.01) |
| ***A47B 57/16*** | (2006.01) |
| ***A47B 57/22*** | (2006.01) |
| ***A47B 57/32*** | (2006.01) |
| ***A47B 57/08*** | (2006.01) |

(52) U.S. Cl.

CPC ..... *A47B 57/10* (2013.01); *A47B 57/08* (2013.01); *A47B 57/16* (2013.01); *A47B 57/22* (2013.01); *A47B 57/32* (2013.01)

(58) Field of Classification Search

CPC ..... A47B 47/00; A47B 57/08; A47B 57/10; A47B 57/12; A47B 57/14; A47B 57/16; A47B 57/22; A47B 57/32; A47B 57/406; A47B 57/48; A47B 57/482; A47B 57/485; A47B 57/487; A47B 57/50; A47B 57/52

USPC ..... 211/187, 189, 190, 191, 192

See application file for complete search history.

(56) References Cited

U.S. PATENT DOCUMENTS 810,545 A * 1/1906 Krag ..... A47B 57/16 108/110

1,059,464 A * 4/1913 Hine ..... A47B 57/265 108/107

(Continued)

FOREIGN PATENT DOCUMENTS

KR 2020130005755 10/2013

*Primary Examiner* — Joshua Rodden

(74) *Attorney, Agent, or Firm* — IPLA P.A.; James E. Bame

(57) ABSTRACT

Provided is a prefabricated shelf which can be used to display or store various products or items in a shop or a warehouse, and may include, but is not limited to, a vertical frame, a horizontal frame and a shelf panel. A horizontal frame having an engaging slot that is engaged to the vertical frame having a plurality of engaging protrusions in a predetermined arrangement, thus easily and durably assembling the shelf without using a separate engaging member, for example, a screw, a bolt, etc., and if necessary it is possible to freely adjust the height of the shelf panel of the prefabricated shelf.

1 Claim, 8 Drawing Sheets

(56) References Cited

U.S. PATENT DOCUMENTS

| | | | | | |
|---|---|---|---|---|---|
| 1,764,131 | A * | 6/1930 | Walter | A47B 57/16 | 108/110 |
| 2,926,978 | A * | 3/1960 | Mitchell | A47B 47/03 | 312/108 |
| 3,010,585 | A * | 11/1961 | Slikkers | A47B 57/04 | 108/1 |
| 3,136,270 | A * | 6/1964 | Von Arb | A47B 57/16 | 108/8 |
| 4,073,556 | A * | 2/1978 | Wilson, Jr. | A47B 57/16 | 248/917 |
| 4,729,484 | A * | 3/1988 | McConnell | A47B 57/402 | 211/183 |
| 5,595,127 | A * | 1/1997 | Eustace | A47B 47/025 | 108/109 |
| 6,920,831 | B2 * | 7/2005 | Lin | A47B 57/408 | 108/107 |
| 7,975,860 | B2 * | 7/2011 | Dittus | H05K 7/1489 | 211/192 |
| 2002/0195410 | A1 * | 12/2002 | Lin | A47B 57/16 | 211/190 |
| 2004/0144741 | A1 * | 7/2004 | Spencer | A47B 57/20 | 211/187 |
| 2005/0103734 | A1 * | 5/2005 | Saltzberg | A47B 57/50 | 211/187 |
| 2006/0144809 | A1 * | 7/2006 | Collins | A47B 47/028 | 211/191 |
| 2011/0042336 | A1 * | 2/2011 | Cheng | A47B 57/40 | 211/153 |
| 2014/0034593 | A1 * | 2/2014 | Chen | A47B 57/50 | 211/134 |

* cited by examiner

PREFABRICATED SHELF

CROSS REFERENCE

This application claims foreign priority under Paris Convention to Korean Patent Application No. 10-2014-0100062, filed 4 Aug. 2014, with the Korean Intellectual Property Office.

BACKGROUND OF THE INVENTION

The present invention relates to a prefabricated shelf which can be used to display or store various products or items in a shop or a warehouse, and in particular to a prefabricated shelf wherein a horizontal frame having an engaging slot is secured to a vertical frame which has a plurality of regularly arranged engaging protrusions, so a shelf panel can be engaged, thus easily and durably assembling a shelf without using any engaging means, for example, a screw, a bolt, etc., while providing an advantage in the way that the height of a shelf crosspiece of a vertical frame can be feely adjusted.

A shelf made of wood, etc. is being widely used. In recent years, such a shelf is being made of various materials, for example, a metallic frame and other various components in an effort to improve the easiness of assembling, disassembling and transportation. A very recently released product can be easily assembled or disassembled without using any engaging means, for example, a bolt, a screw or a tool. As an example of such a shelf, there is a prefabricated shelf of Korean Patent Application No. 20-2012-002372 wherein a horizontal beam is secured to a vertical beam using an engaging slit, etc., and the other side thereof in a longitudinal direction is arranged getting far from the vertical beam, which makes it possible to assemble or disassemble the shelf without using any engaging means. In this product, only one end of the horizontal beam is fixed to the vertical beam, and the other end thereof is configured to get far from the vertical beam. For this, there may be a limit in supporting the weights of a shelf itself and the items arranged on the shelf.

SUMMARY OF THE INVENTION

Accordingly, it is an object of the present invention to provide a prefabricated shelf wherein the weights of a shelf panel, items and others can be efficiently supported in such a way that an engaging slot formed at a horizontal frame is engaged to a plurality of engaging protrusions formed at regular intervals at a vertical frame.

It is another object of the present invention to provide a prefabricated shelf wherein it is possible that a shelf can be manufactured by engaging a vertical frame and a horizontal frame without using an engaging member, and the engaged vertical frame and horizontal frame can support the weights of the shelf panels and the items on the shelf panels.

To achieve the above objects, there is provided a prefabricated shelf which may include, but is not limited to, a vertical frame and a horizontal frame which is engaged to the vertical frame.

A plurality of engaging protrusions are formed at regular intervals at the left and right sides of the vertical frame. The horizontal frame having engaging slots that are engaged to the engaging protrusions. The horizontal frame may include a shelf panel engaging member, thus allowing the shelf panel to insert and engage. A plurality of the horizontal frames are engaged to 4 vertical frames, and the shelf panels are engaged to the shelf panel engaging member of the horizontal frame, thus manufacturing a prefabricated shelf.

In the prefabrication shelf of the present invention, a shelf can be assembled in such a way that a horizontal panel made of a horizontal flat plate can be easily and reliably engaged to a vertical frame without using a separate engaging means, for example, a screw, a bolt, etc., and the shelf panels can be easily and quickly mounted.

Since a plurality of engaging protrusions are provided at regular intervals at the vertical frame, it is possible to freely adjust the heights of the shelf panels, if necessary, by using the engaging slots of the horizontal frame to which the shelf panels are engaged, thus maximizing the applicability of the prefabricated shelf.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

Figure 1:
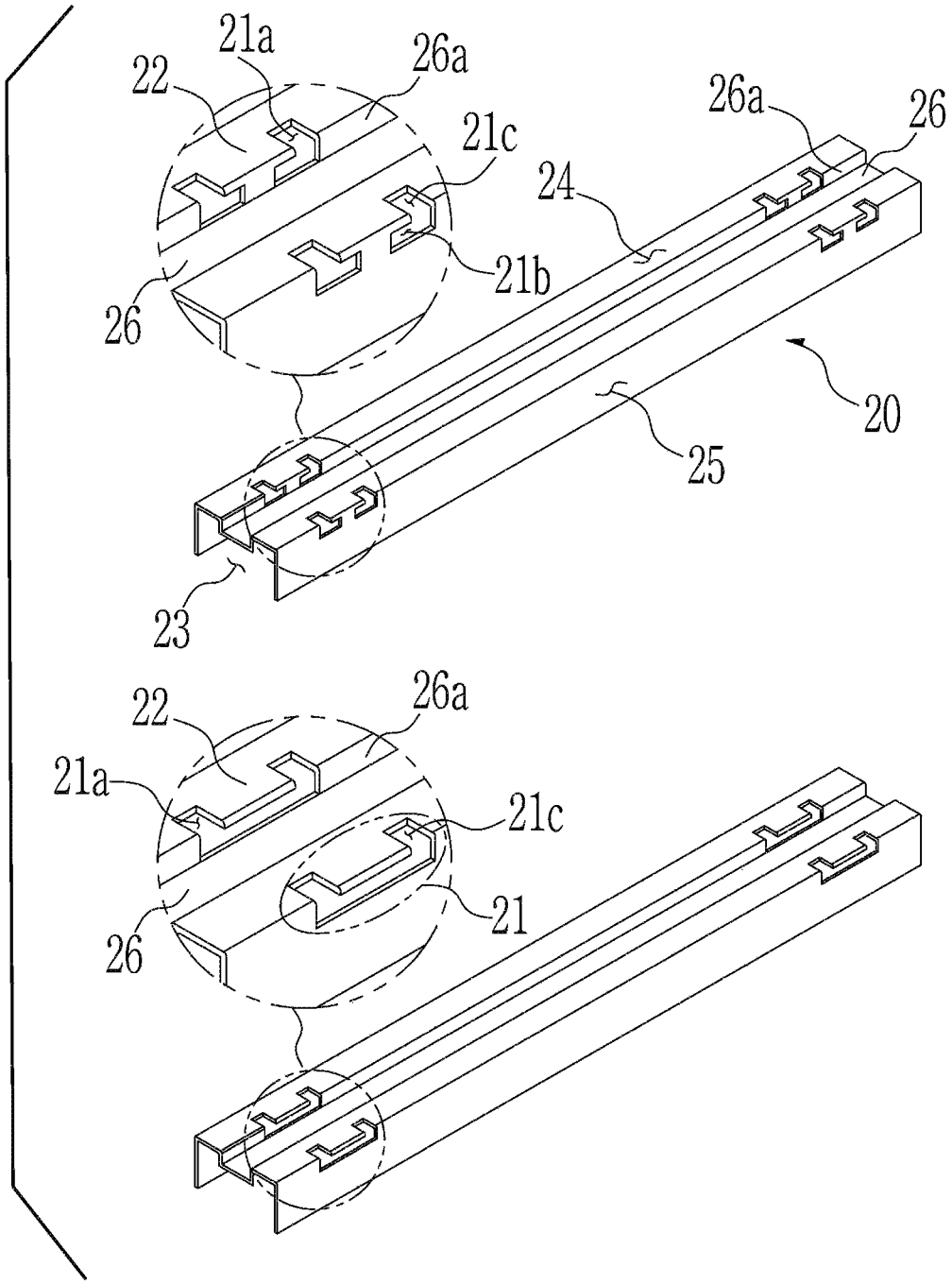
FIG. 1 is a detailed view illustrating a horizontal frame which is a configuration component of a prefabricated shelf according to the present invention.

The present invention will be described in detail with reference to the present invention.

The present invention is directed to a prefabricated shelf which may include, but is not limited to, a vertical frame 10, a horizontal frame 20, and a shelf panel 30.

More specifically, in order to assemble a box-shaped shelf without using a separate engaging member, the vertical frame 10 having an engaging protrusion 11 and the horizontal frame 20 having an engaging slot 21 are used. The horizontal frame 20 is connected between the four vertical frames 10, the shelf panel 30 is inserted and engaged between the horizontal frames 20, thus fabricating a shelf in a multilayer structure the height of which can be adjusted.

Figure 2:
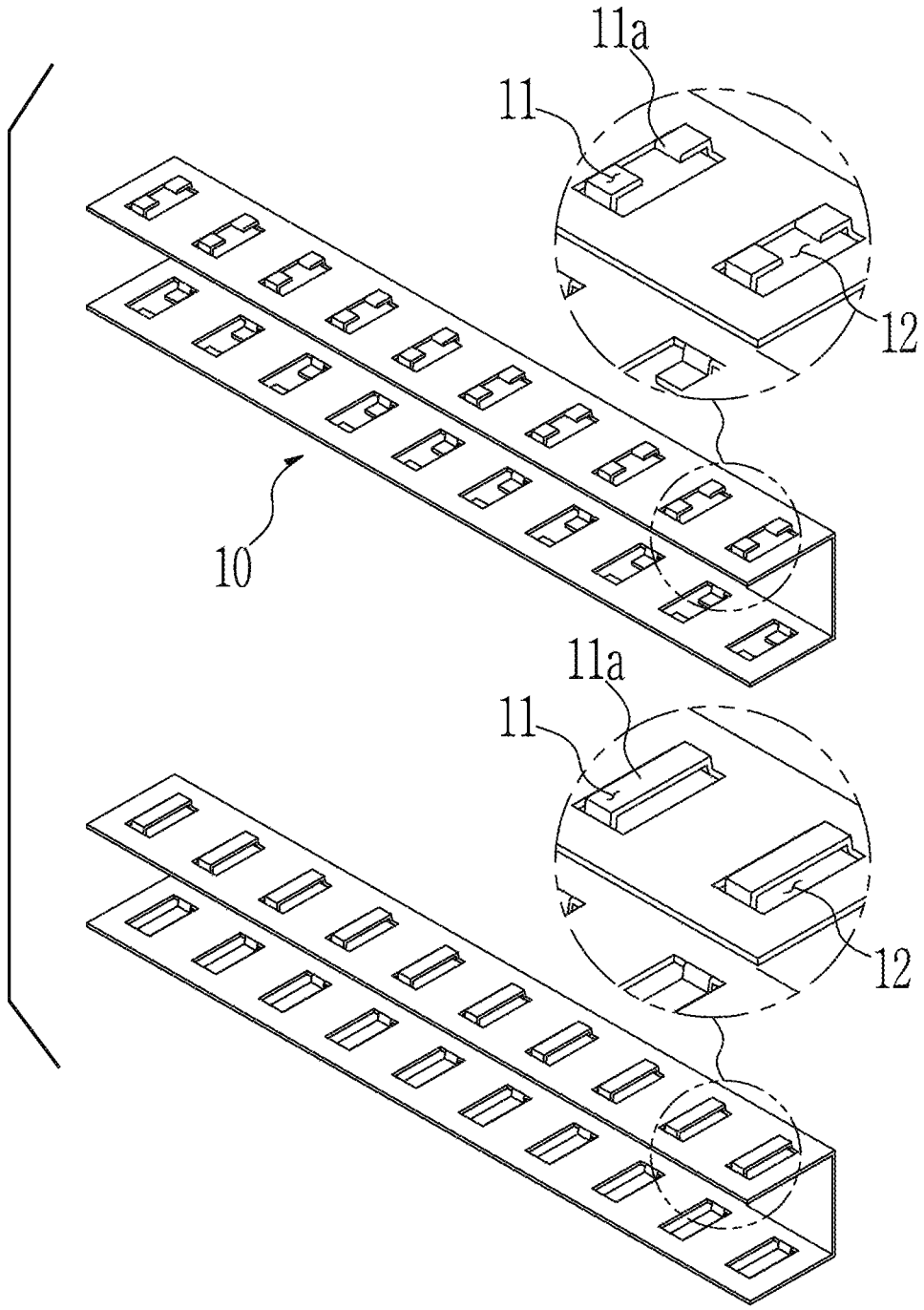
FIG. 2 is a detailed view illustrating a vertical frame which is a configuration component of a prefabricated shelf according to the present invention.

More specifically, as illustrated in FIG. 2, a plurality of engaging protrusions 11 are arranged at regular intervals at the left and right sides of the vertical frame 10.

Figure 4:
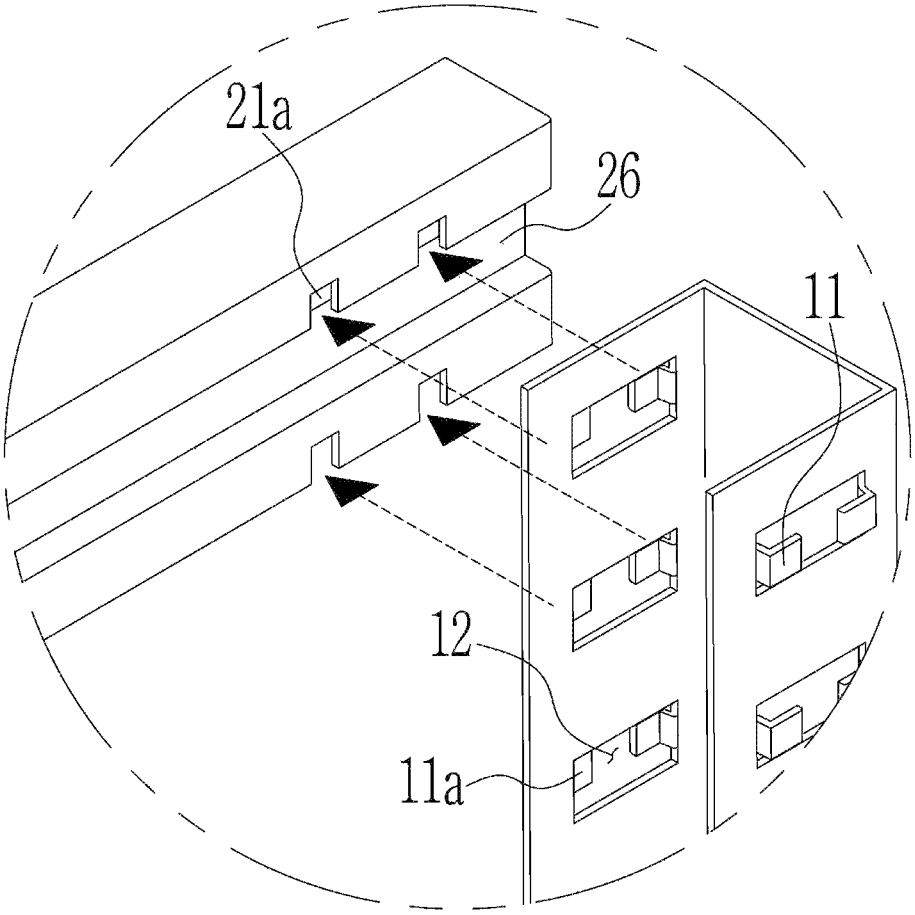
FIG. 4 is a detailed view illustrating an engagement between a vertical frame and a horizontal frame which are configuration components of a prefabricated shelf according to the present invention.
Figure 5:
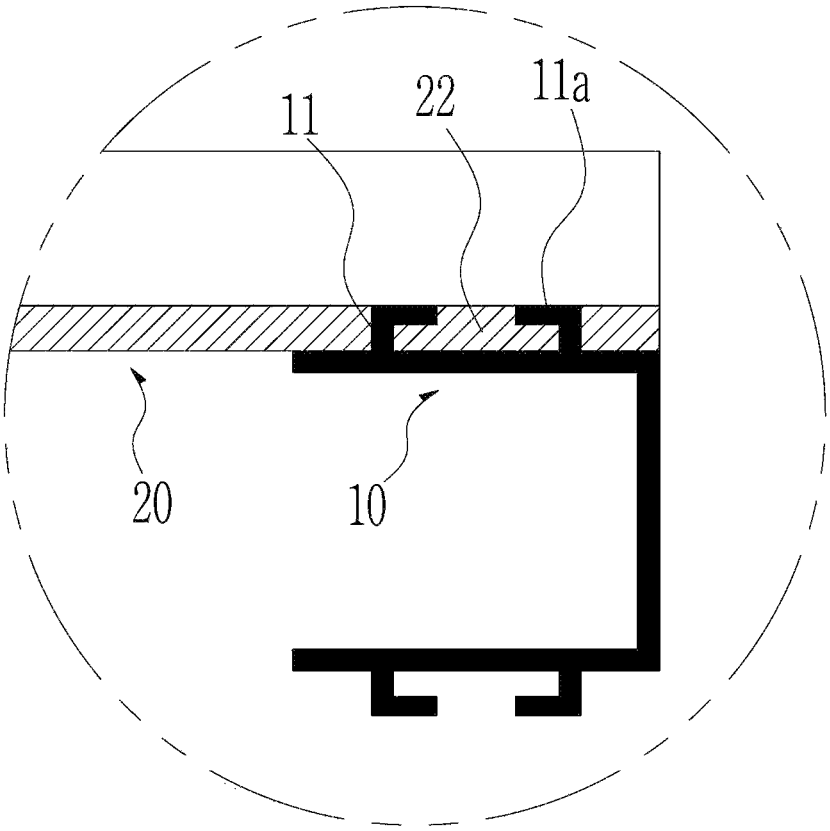
FIG. 5 is a cross sectional view illustrating an engagement between a vertical frame and a horizontal frame which are configuration components of a prefabricated shelf according to the present invention.
Figure 6:
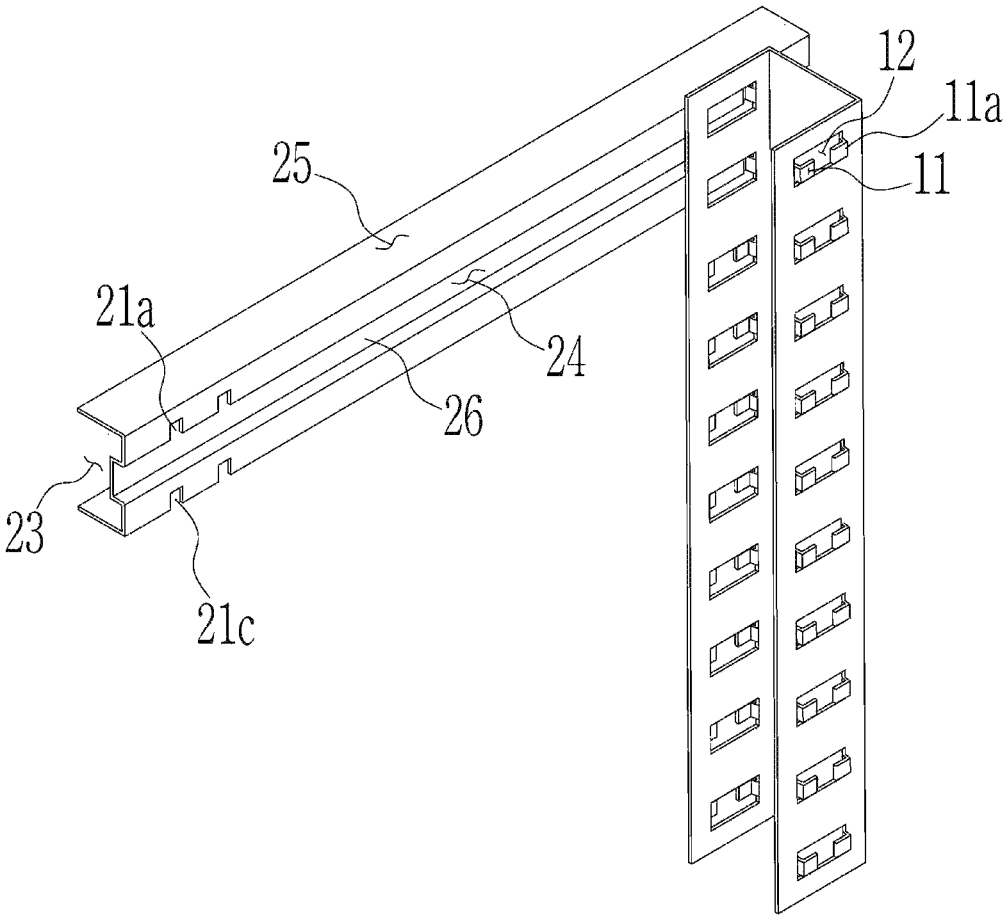
FIG. 6 is a view illustrating an engagement between a vertical frame and a horizontal frame which are configuration components of a prefabricated shelf according to the present invention.

Namely, the engaging protrusion 11 is engaged to or formed at a quadrangular perforation portion 12 at the left and right sides of the vertical frame 10. A plurality of the quadrangular perforation portions 12 are arranged at regular intervals. A U-shaped or center-open U-shaped engaging protrusion 11 is formed at or engaged to both sides of each perforation portion 12. When the engaging protrusion 11 is engaged to the engaging slot 21 of the horizontal frame 20, since the U-shaped or center-open U-shape plays a role of an engaging portion 11*a* with respect to the engaging slot 21 of the horizontal frame, as illustrated in FIG. 4, it is possible to maintain a durably engaged state.

Figure 3:
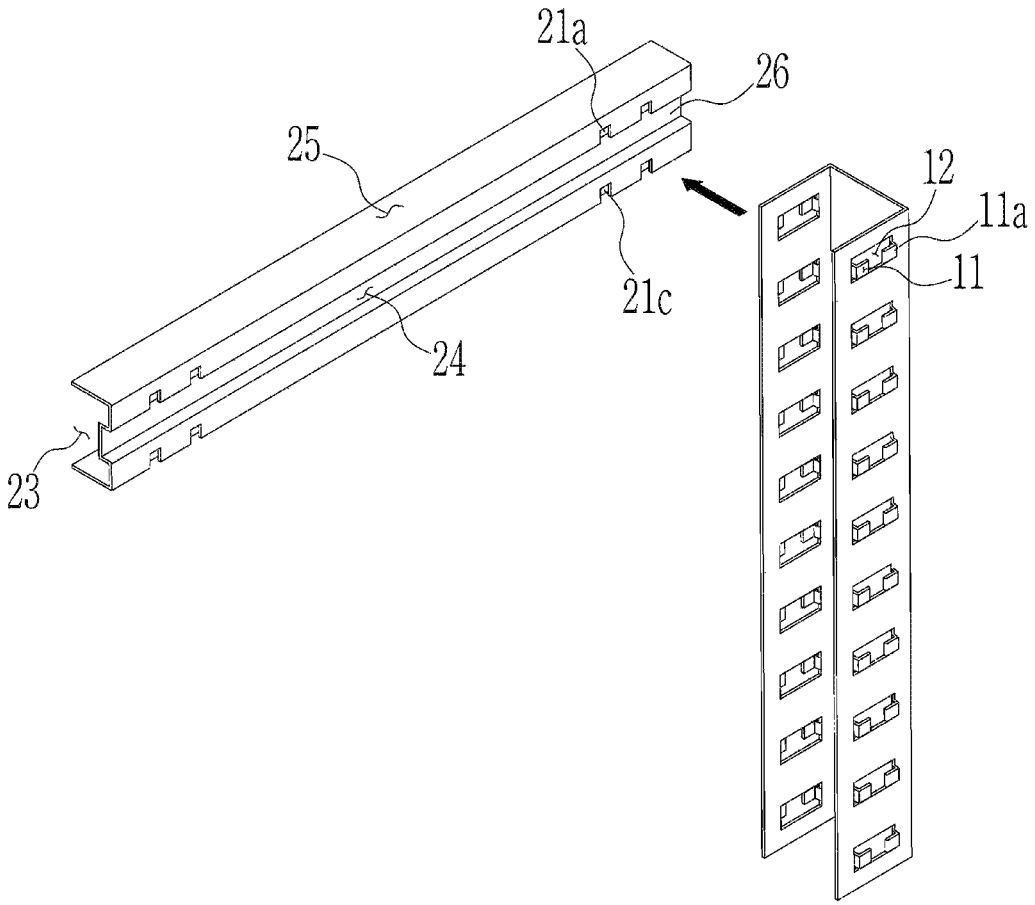
FIG. 3 is a view illustrating an example where a vertical frame and a horizontal frame which are configuration components of a prefabricated shelf are engaged to each other according to the present invention.

Here, the horizontal frame 20 is formed in a C-shape the open side of which becomes an open shelf panel engaging portion 23 to which the shelf panel 30 is engaged, and at the closed side of the other side or the center portion of the upper side 24, as illustrated in FIG. 1, a quadrangular horizontal slot 26 is formed sunk in a longitudinal direction. As illustrated in FIGS. 1, 3 and 4, the engaging slot 21 is formed of a lower side engaging slot 21*b* and an upper side engaging slot 21*a*. The upper and lower side engaging slots are formed in the U-shaped or center-open U-shape and are arranged at the same intervals as the intervals of the two engaging protrusions 11. The two engaging protrusions 11 are engaged to the upper and lower side engaging slots 21*a* and 21*b*, respectively. The upper side engaging slot 21*a* is perforated from an upper side wall surface 26*a* of the sunk horizontal slot to the upper surface 24 of the horizontal frame 20. The lower engaging slot 21*b* is perforated in a U-shaped or center-open U-shape from the side surface of the horizontal fame 20 to the upper surface. To this end, the engaging protrusion 11 of the vertical frame 10, as illustrated in FIG. 4, can be inserted into the perforated portion formed at the upper side wall surface 26*a* and the side surface 25 of the upper and lower side engaging slots 21*a* and 21*b* of the horizontal frame. When the horizontal frame 20 is pressed from top to bottom, the engaging protrusion 11 will enter the perforated portion 21*c* of the upper surface 24 of the upper and lower side engaging slots 21*a* and 21*b*, and the engaging member 11*a* of the engaging protrusion 11 can be stably fixed at the upper surface 24 of the horizontal frame 20 by an engaging fixing member 22 formed between the perforation portions 21*c*.

In addition, when it needs to disengage the horizontal frame 20 from the vertical frame 10, the engaged horizontal frame is pressed from bottom to top, thus disengaging the horizontal frame 20. Thereafter, the shelf panel is engaged to the open shelf panel engaging portion 23, and books or items are put on the upper surface 24. In this state, since the weight applies downward thanks to gravity, the shelf or the horizontal frame 20 will be disengaged from the vertical frame 10, thus obtaining a stable engagement without any wobbling.

The shelf panel 30 can be engaged through the open shelf panel engaging portion of the horizontal frame 20, thus manufacturing a prefabricated shelf.

Figure 7:
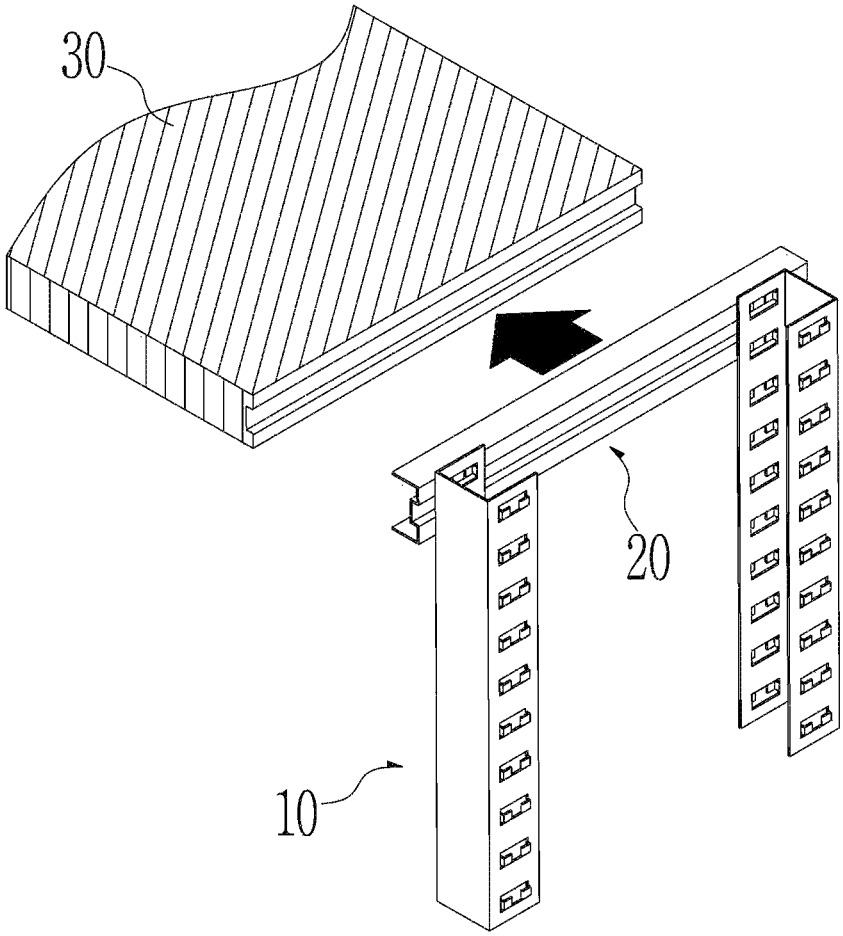
FIG. 7 is a detailed view illustrating a shelf panel which is engaged to a horizontal frame which is a configuration component of a prefabricated shelf according to the present invention.
Figure 8:
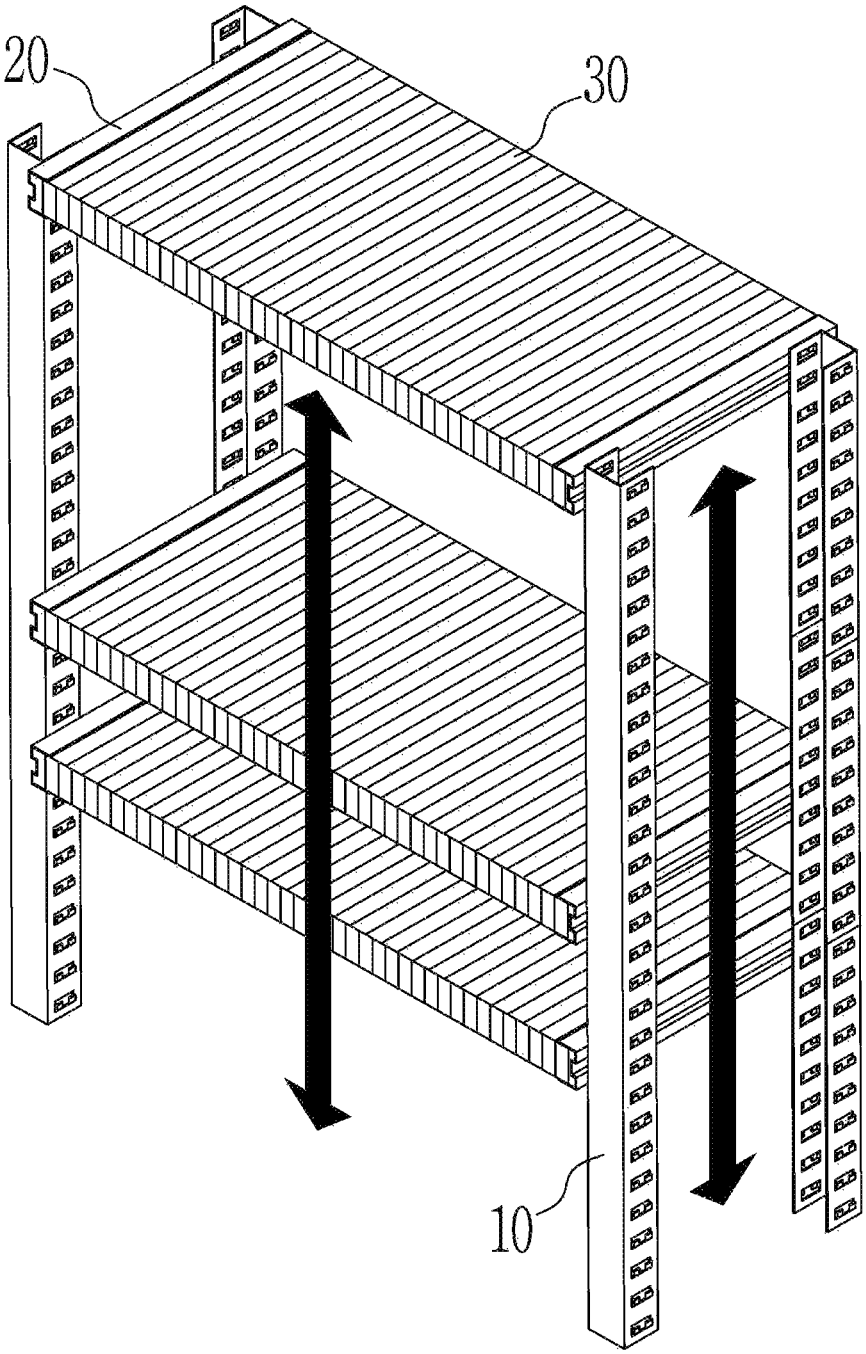
FIG. 8 is a perspective view illustrating a finished, prefabricated shelf which has been manufactured as a vertical frame, a horizontal frame and a shelf panel, which are configuration components of a prefabricated shelf, are engaged according to the present invention.

As illustrated in FIG. 7, since the vertical frame 10 may include a plurality of engaging protrusions 11 at upper and lower sides, and the horizontal frame 20 is engaged with the engaging protrusion 11 of the vertical frame 10, so the shelf panel 30 can be freely installed at a height that a user wants and can be configured in a form of multiple layers.

As illustrated in FIG. 2, a plurality of engaging protrusions are formed at regular intervals at the left and right sides of the vertical frame 10, and the engaging protrusions formed at the outer most portion between the left side or the right side may be used when it needs to expand the shelf.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

[Legend of Reference]

| | |
|---|---|
| 10: Vertical frame | 11: Engaging protrusion |
| 11a: Engaging portion | 12: Perforation portion |
| 21: Engaging slot | 21a: Upper side engaging slot |
| 21b: Slower side engaging slot | |
| 21c: Upper side perforation portion | |
| 22: Engaging fixing member | |
| 23: Open shelf panel engaging portion | |
| 24: Upper surface | 25: Side surface |
| 26: Horizontal slot | 26a: Upper side wall surface |
| 30: Shelf panel" | |

What is claimed is:

1. A prefabricated shelf, comprising:

a leading vertical frame which includes a perforation portion formed at left and right sides with a predetermined arrangement in a quadrangular shape, and a U-shaped or a center-opened U-shaped engaging protrusion which is formed at or engaged to both sides of the perforation portion;

a leading horizontal frame which includes a horizontal slot engaged to one of the engaging protrusions of the vertical frame and formed in a C-shape and sunk in a quadrangular shape on a center portion of an upper surface of an other side of an open shelf panel engaging portion to which a shelf panel is engaged, a lower side engaging slot which perforates from a side surface to an upper surface in a U-shape or a center-open U-shape, and an upper engaging slot which perforates from an upper side wall surface to the upper surface of the horizontal frame in a U-shape or a center-open U-shape; and the shelf panel which is fixedly engaged between the horizontal frame and an adjacent horizontal frame, wherein the leading horizontal frame is connected between the leading vertical frame and three other vertical frames, and the shelf panel is inserted and engaged between the leading horizontal frame and the adjacent horizontal frame, thus freely adjusting the height of the shelf panel engaged to the leading horizontal frame based on the engaged height of the leading horizontal frame.

* * * * *